US007611254B1

(12) United States Patent
Yu et al.

(10) Patent No.: US 7,611,254 B1
(45) Date of Patent: Nov. 3, 2009

(54) LIGHT BATON FOR USE IN AQUATIC GAMES

(76) Inventors: Wei Hung Yu, 16 Faith, Irvine, CA (US) 92612; Connie Wang, 16 Faith, Irvine, CA (US) 92612

( * ) Notice: Subject to any disclaimer, the term of this patent is extended or adjusted under 35 U.S.C. 154(b) by 0 days.

(21) Appl. No.: 12/379,557

(22) Filed: Feb. 25, 2009

(51) Int. Cl.
*F21V 33/00* (2006.01)

(52) U.S. Cl. ..... 362/102; 362/96; 362/101; 362/318; 362/577

(58) Field of Classification Search ..... 362/96, 362/101, 102, 120, 154, 171, 184, 190, 200, 362/202, 208, 219, 223, 240, 244, 246, 257, 362/267, 318, 551, 555, 577, 800, 806
See application file for complete search history.

(56) References Cited

U.S. PATENT DOCUMENTS 4,600,974 A * 7/1986 Lew et al. ..... 362/102
4,858,083 A * 8/1989 Wakimoto ..... 362/101
5,165,781 A * 11/1992 Orak ..... 362/186
5,865,524 A * 2/1999 Campman ..... 362/102
5,890,794 A * 4/1999 Abtahi et al. ..... 362/294
6,612,712 B2 * 9/2003 Nepil ..... 362/101
7,261,456 B2 * 8/2007 Liu ..... 362/577

* cited by examiner

*Primary Examiner*—Hargobind S Sawhney
(74) *Attorney, Agent, or Firm*—Bacon & Thomas, PLLC

(57) ABSTRACT

This invention is a light baton for use in aquatic games, comprising a translucent baton body, end inserts at both ends of the baton body, an end insert connected to an inserted light-emitting module, holes in the translucent baton body, and arcuate convex protuberances on the outer surface of the translucent baton body; the holes in the translucent baton body allow water to flow in and surround the light-emitting module, with the change in air and water density causing the baton to sink in water, while the liquid has a refractive effect on the colorful lights from the light-emitting module; the colorful beams of light pass through and are refracted by the ripples in the liquid within the baton body to produce illumination, making the baton ideal for having fun in water.

6 Claims, 5 Drawing Sheets

LIGHT BATON FOR USE IN AQUATIC GAMES

BACKGROUND OF THE INVENTION

1. Field of the Invention

The present invention provides a light baton for use in aquatic games, specifically a light-emitting baton body structure for enhancing enjoyment at aquatic recreation areas. Because the translucent baton body has holes in it, and one end is equipped with a light-emitting module, the light baton easily sinks in water, creating a colorful flickering light source refracted by ripples in the water, making the baton bright and fun to use.

2. Description of the Prior Art

As swimming is a form of exercise that uses the body's buoyancy in water and uses the arms and legs to stroke through the water, it can exercise muscles throughout the body and expand lung capacity, making swimming, among numerous forms of exercise, one of the best for effectively exercising the entire body. On the other hand, beginners or those playing in the water, especially toddlers or children learning to swim, may develop an inexplicable fear of the water, or, despite having learned to swim, give up aquatic sports due to lack of interest. Therefore, how to help those learning to swim or participating in aquatic recreation to overcome their fear of water or take an interest in aquatic sports, developing an implement that would be both entertaining and useful and increase people's enjoyment of swimming were among the problems the designers considered and wanted to solve.

The present inventor, noting the opportunity to improve upon the drawbacks described above, has devoted a great deal of energy to research and putting the findings to use, finally disclosing the present invention, a reasonable design that effectively improves upon the aforementioned drawbacks.

SUMMARY OF THE INVENTION

The present invention relates to a light baton for use in aquatic games, comprising a translucent baton body, and inserts at both ends of the baton body, one of which is equipped with a light-emitting module. The translucent baton body has holes in it, and arcuate convex protuberances on the outer surface, therefore, the beams of light from the light-emitting module are refracted by ripples in liquid inside the baton body, creating colorful illumination, and making the baton ideal for having fun in water.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
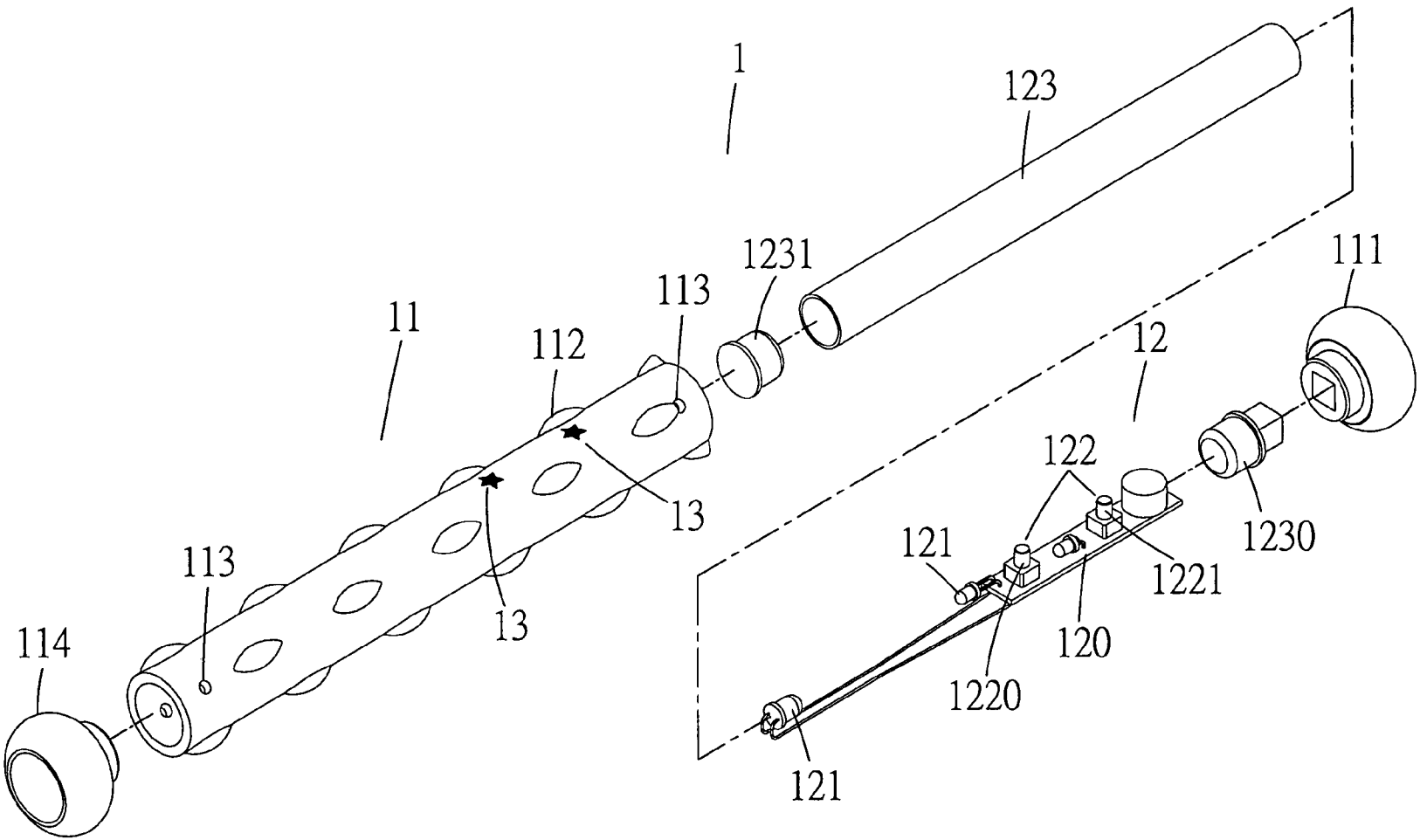
FIG. 1 is an exploded perspective view of the light baton for use in aquatic games in the present invention.
Figure 2:
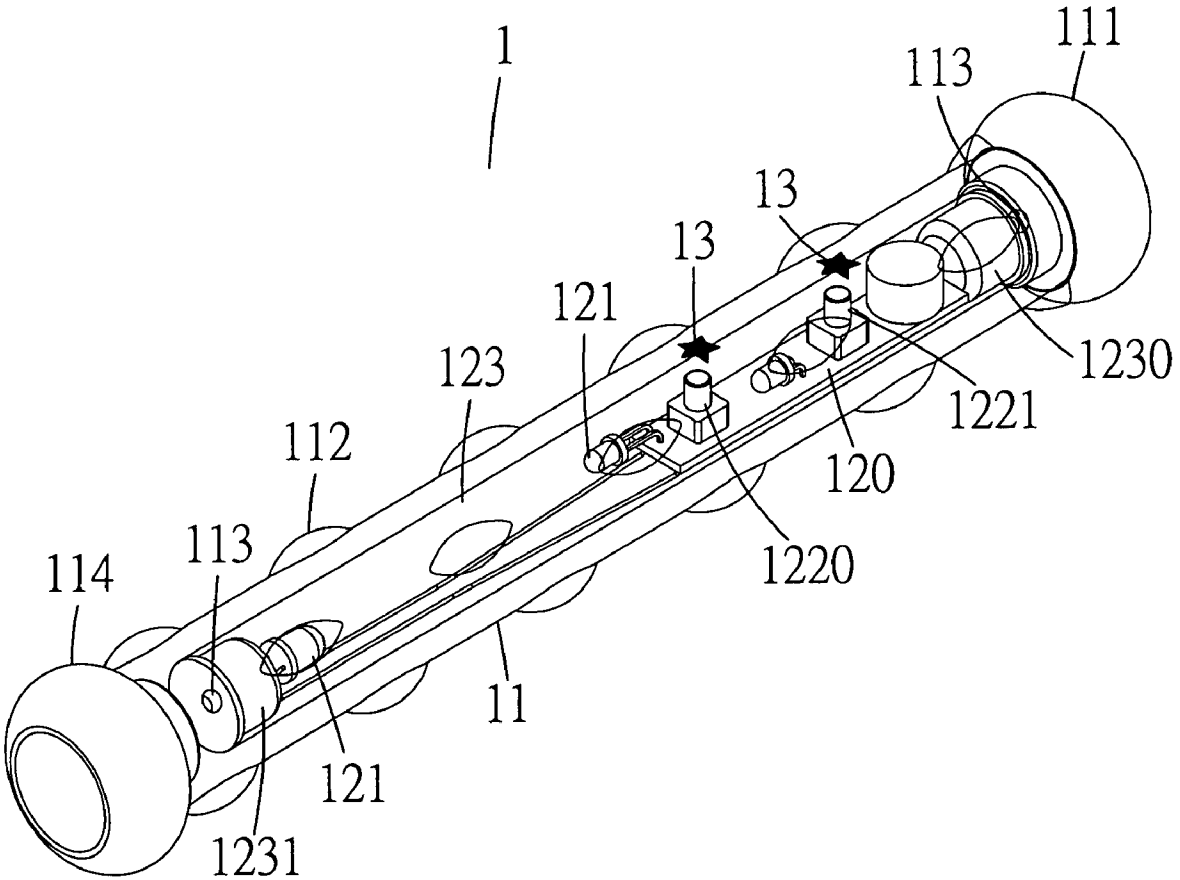
FIG. 2 is a perspective view of the light baton use in aquatic games in the present invention.
Figure 3A:
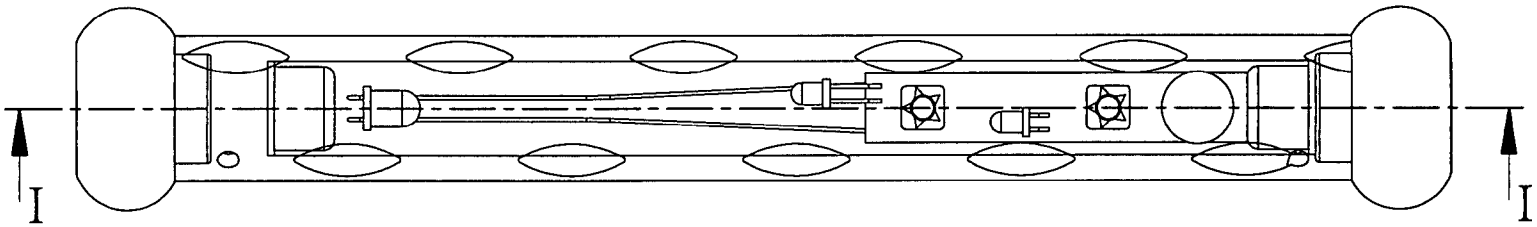
FIG. 3*a* is a side-view is a perspective view of the present invention.
Figure 3B:
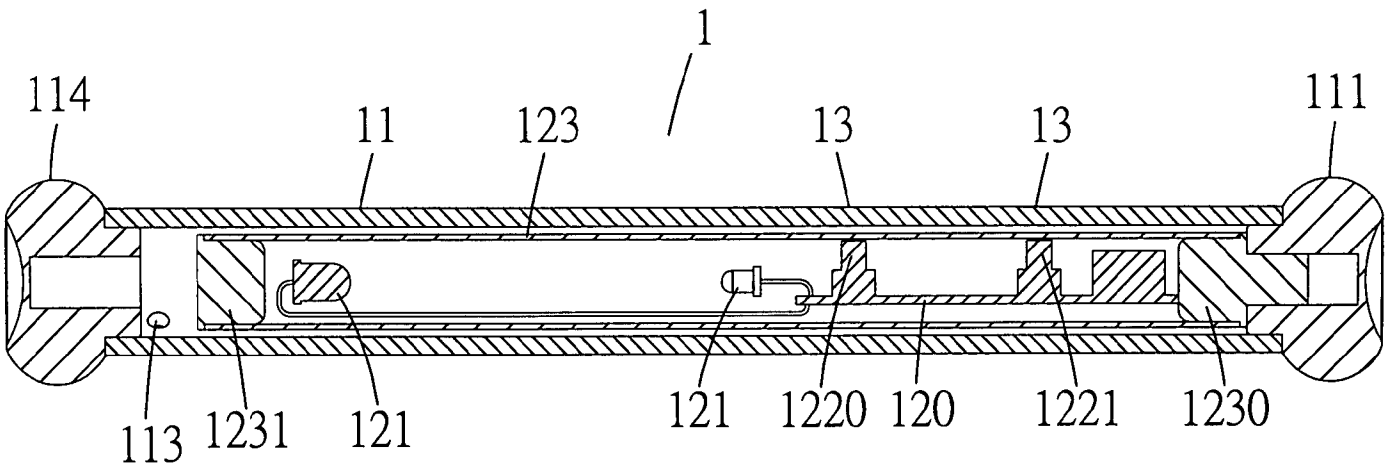
FIG. 3*b* is a cross sectional view, taken along line I-I of FIG. 3*a;*
Figure 4:
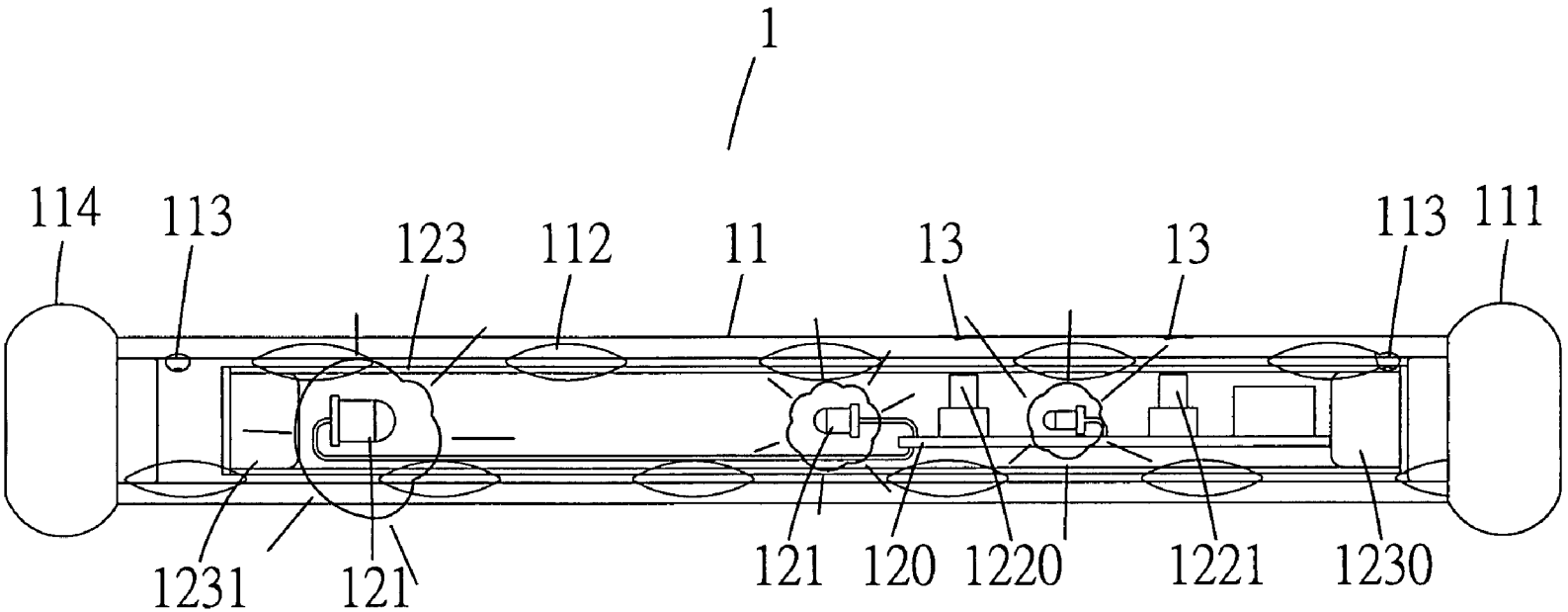
FIG. 4 is perspective view of the light baton use in aquatic games in using condition in the present invention.
Figure 5:
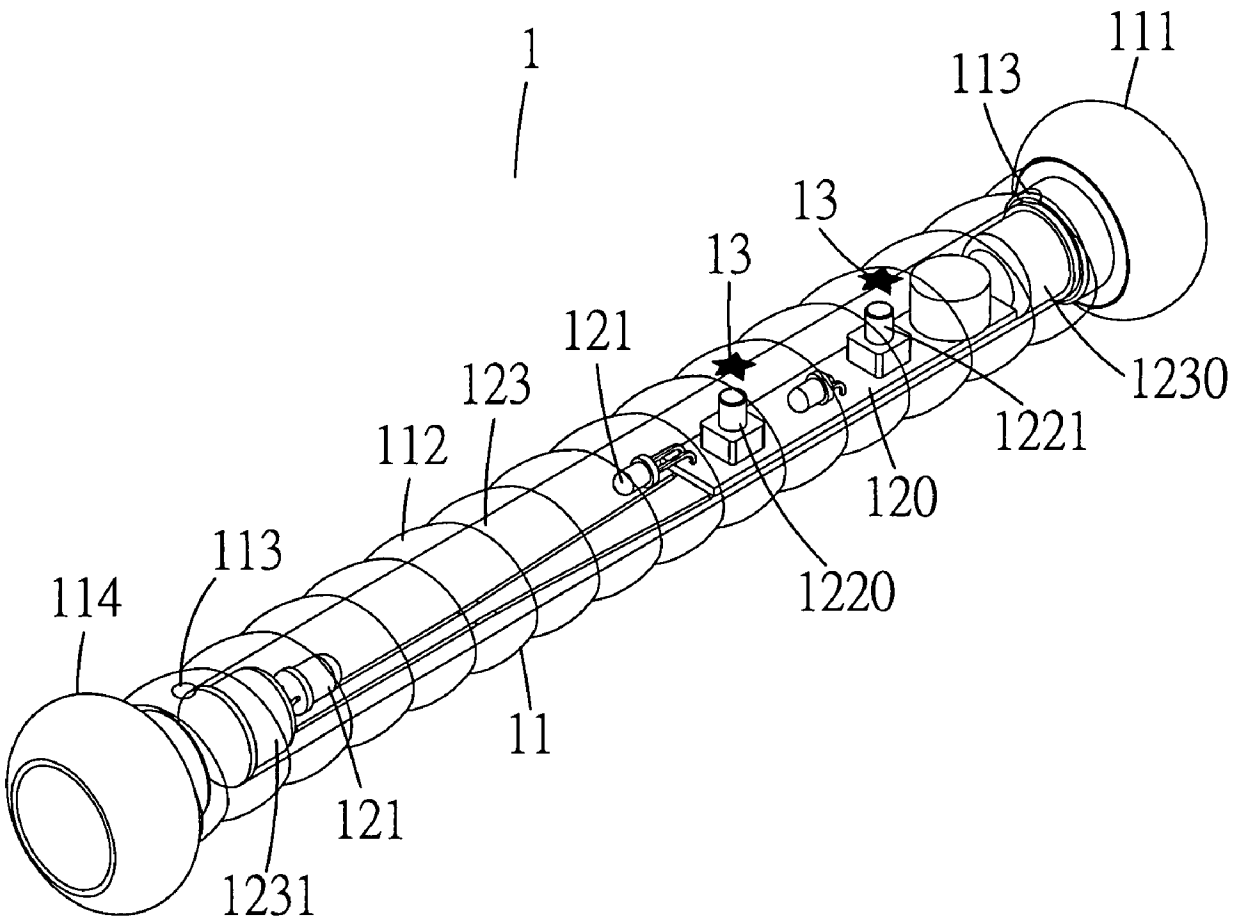
FIG. 5 is a perspective view of another actual embodiment of the light baton for use in aquatic games in the present invention.

A preferred embodiment of a light baton for use in aquatic games in the present invention, as shown in FIGS. 1 to 5.

The light baton 1 is comprised mainly of a translucent rubber baton body 11; the two ends of the translucent baton body 11 are fitted with insert end 111 and insert end 114; insert end 111 is connected to the light-emitting module 12. The exterior of the translucent baton body 11 has arcuate convex protuberances 112 and holes 113; the translucent baton body 11 is provided with a depressible section 13 connected to the light-emitting module's 12 power switch 122. The other end insert 114 is fitted into the other end of the translucent baton body 11. Translucent baton body 11 is rod shaped and one end of the translucent baton body 11 is firmly affixed to end insert 111. Light-emitting module 12 comprises of a circuit board 120, light-emitting diodes 121, power switch 122, and a translucent tube 123. The light-emitting diodes 121 is comprised of several different colored light-emitting diode; the circuit board 120 is designed to make the light-emitting diodes 121 change and flash. The power switch 122 connects to and controls the circuit board 120 and the light-emitting diodes 121. The power switch 122 is equipped with a timer button 1220 and an on/off button 1221. The translucent tube 123 surrounds the circuit board 120, the light-emitting diodes 121 and the power switch 122, which are sealed inside with stoppers 1230 and 1231 to prevent water from entering and interfering with electrical conduction.

During aquatic (swimming pool) games, the power switch 122 is activated and the baton 1 is dropped into the water. It will immediately fill with water through the holes 113 on the translucent baton body 11 and sink in the water. The liquid surrounding the light-emitting module 12 inside the light baton 1 and the arcuate convex protuberances 112 on the surface of translucent baton body 11 both serve to create dazzling and colorful refracted illumination, making the light baton 1 brighter and more eye-catching in the water.

The above explanation shows that this invention has the following advantages:

1. The present invention of a light baton 1 makes use of a translucent baton body 11, light-emitting module 12 and the effect of water to magnify and further project the rays of light from the light-emitting module 12 as they pass through the water.

2. The present invention of a light baton 1, make use of arcuate convex protuberances 112, causing the beams of light from the light-emitting module 12 to be refracted by both the convex pattern and the water; the light source of the light-emitting module 12 is housed within the translucent baton body 11, the translucence of which makes the baton itself a glimmering light source.

3. Because the present invention of a light baton 1 has holes 113, liquid can easily flow inside of the translucent baton body 11, both causing the colorful light source of the light-emitting module 12 to be refracted and causing it to easily sink in water, allowing users to make a game of finding it.

While the preferred embodiment of the invention has been described above, it will be recognized and understood that various modifications may be made therein and the appended claims are intended to cover all such modifications that may fall within the spirit and scope of the invention.

What is claimed is:

1. A light baton for use in aquatic games comprising:

a translucent baton body, with end inserts at both ends, into one of which is inserted a light-emitting module, the outer surface of the translucent baton body is provided with several holes and arcuate convex protuberances, and the translucent baton body is equipped with holes;

When the translucent baton body is dropped into water, the holes in the baton body allow liquids to easily flow in, and as the air inside the baton body is forced out by water density, the light baton sinks easily, providing the users with an aquatic game.

2. A light baton for use in aquatic games as claimed in claim 1, wherein the light is a light-emitting diode (LED).

3. A light baton for use in aquatic games as claimed in claim 1, wherein the two end inserts at the ends of the translucent baton body are comprised of stoppers and a light-emitting module, which seal both ends of the light baton.

4. A light baton for use in aquatic games as claimed in claim 1, wherein the light-emitting module is fitted with a circuit board, a set of light-emitting diodes, and a power switch, which can control the activation or shutoff of the light baton's power source.

5. A light baton for use in water games as claimed in claim 1, wherein the translucent baton body is provided with a depressible section which corresponds to the controller of the light emission module's activation and shutoff.

6. A light baton for use in aquatic games as claimed in claim 1, wherein the translucent baton body is made of translucent rubber, and therefore easy for users to press.

* * * * *